US010730317B2

(12) United States Patent
Martellono

(10) Patent No.: US 10,730,317 B2
(45) Date of Patent: Aug. 4, 2020

(54) METHOD AND UNIT FOR THERMOSETTING PRINTED FABRICS

(71) Applicant: ATPCOLOR S.r.l., Senago (Milan) (IT)

(72) Inventor: Roberto Maria Martellono, Cerano (IT)

(73) Assignee: ATPCOLOR S.r.l., Senago (Milan) (IT)

( * ) Notice: Subject to any disclaimer, the term of this patent is extended or adjusted under 35 U.S.C. 154(b) by 0 days.

(21) Appl. No.: 16/169,104

(22) Filed: Oct. 24, 2018

(65) Prior Publication Data

US 2019/0143714 A1 May 16, 2019

(30) Foreign Application Priority Data

Nov. 15, 2017 (IT) ..... 102017000130591

(51) Int. Cl.

| | |
|---|---|
| ***B41J 3/407*** | (2006.01) |
| ***B41J 11/00*** | (2006.01) |
| ***B41J 15/04*** | (2006.01) |
| ***D06P 5/24*** | (2006.01) |
| ***D06B 23/02*** | (2006.01) |
| ***D06B 19/00*** | (2006.01) |

(Continued)

(52) U.S. Cl.

CPC ..... *B41J 3/4078* (2013.01); *B41J 11/002* (2013.01); *D06B 19/0076* (2013.01);

(Continued)

(58) Field of Classification Search

CPC ..... B65H 23/26; B65H 2404/14211; B41J 3/4078; B41J 11/002; B41J 29/377; B41J 2/01; B41J 2/211; B41J 2/1433; B41J 2/17; B41J 2/17593; B41J 2/2107; B41J 2/1755; B41J 2/2114; B41J 2/2117; B41J 2/2056; B41J 2/21; B41J 2/0057; B41J 3/60; B41J 2002/012; B41J 2/04598; B41J 2/04588; B41J 2/04595; B41J 2/04586; B41J 2/14274; B41J 11/0015; B41M 5/0047; B41M 5/0011; B41M 5/0017; B41M 7/00; B41M 7/0072; B41M 5/52; B41M 5/5218; D06P 5/001; D06B 19/0076; C09D 11/36;

(Continued)

(56) References Cited

U.S. PATENT DOCUMENTS

2004/0189773 A1* 9/2004 Masumi ..... B41J 11/002 347/102
2006/0146111 A1* 7/2006 Vanous ..... G03D 13/002 347/113

(Continued)

FOREIGN PATENT DOCUMENTS

| | | |
|---|---|---|
| EP | 3145722 A1 | 3/2017 |
| WO | 2016008575 A1 | 1/2016 |
| WO | 2017007327 A1 | 1/2017 |

OTHER PUBLICATIONS

Italian Search Report and Written Opinion dated Jul. 5, 2018 for Application No. IT201700130591.

*Primary Examiner* — Manish S Shah

(74) *Attorney, Agent, or Firm* — Patterson + Sheridan, LLP

(57) ABSTRACT

A method for thermosetting printed fabrics, comprising: providing a heated roller rotatable about a rotation axis and having a cylindrical outer surface, advancing a printed fabric in contact with the cylindrical outer surface of the heated roller, wherein the heated roller is rotated with a peripheral speed different from the speed of the fabric.

8 Claims, 2 Drawing Sheets

(51) Int. Cl.
*F26B 13/08* (2006.01)
*F26B 13/14* (2006.01)

(52) U.S. Cl.
CPC ..... *D06B 23/028* (2013.01); *D06P 5/003* (2013.01); *F26B 13/08* (2013.01); *B41J 15/04* (2013.01); *F26B 13/14* (2013.01)

(58) Field of Classification Search
CPC ..... C09D 11/40; C09D 11/30; C09D 11/38; C09D 11/32; C09D 11/322; C09D 11/324; C09D 11/328; C09D 11/101; C09D 11/102; C09D 11/005; C09D 11/54; C09D 11/52
See application file for complete search history.

(56) References Cited

U.S. PATENT DOCUMENTS

2009/0219328 A1* 9/2009 Godil ..... B41J 2/0057 347/19
2009/0245844 A1* 10/2009 Tsueda ..... G03G 15/2039 399/69
2009/0322824 A1* 12/2009 Hori ..... B41J 2/16585 347/30
2010/0232822 A1* 9/2010 Takenaka ..... G03G 15/2053 399/69
2011/0228289 A1* 9/2011 Yamamoto ..... B41J 11/002 358/1.8
2017/0259586 A1* 9/2017 Wilkinson ..... B41J 2/04586

* cited by examiner

METHOD AND UNIT FOR THERMOSETTING PRINTED FABRICS

CROSS-REFERENCE TO RELATED APPLICATIONS

This application claims benefit of Italian patent application number 102017000130591, filed Nov. 15, 2017 which is herein incorporated by reference.

BACKGROUND OF THE INVENTION

Field of the Invention

The present invention relates in general to methods for digital printing on fabrics.

More particularly, the invention relates to a method and a unit for thermosetting printed fabrics.

Description of Prior Art

In digital printing on fabrics, thermosetting of the inks on fabrics may be necessary. The thermosetting of printed fabrics is normally carried out by advancing the printed fabric around a heated roller. The thermosetting unit for printed fabrics can be an integral part of the textile printer (in-line thermosetting) or it can be a separate apparatus with respect to the textile printer.

The heated roller has a cylindrical outer surface heated to temperatures of up to 200° C. Heating of the outer surface of the heated roller can be obtained by means of a heating circuit using a diathermic fluid (typically oil) circulating inside the roller, which carries out the heating of the outer surface of the roller by conduction. Heated rollers are also known that comprise infrared lamps as heating elements which heat the outer surface of the roller by irradiation and convection.

Heating of the rollers by means of infrared lamps offers considerable advantages with respect to heating systems using diathermic fluids, especially in that they do not require a circuit for heating and circulation of the diathermic fluid inside the roller.

An infrared lamp for heating a heated roller generally comprises a quartz crystal body in which an electrical resistance is inserted which emits infrared light. The infrared lamp extends along the entire length of the heated roller and is supported in a stationary position inside the heated roller. The infrared lamp reaches temperatures on the surface of the quartz crystal body that can exceed 700° C. The heated roller, during operation, rotates about a rotation axis around the infrared lamp which remains stationary.

A limit of infrared heating technology compared to heating systems using diathermic oil consists in the fact that while the diathermic oil has a substantially constant temperature inside the heated roller and keeps the outer surface of the roller heated to a substantially constant temperature, the infrared lamp mainly heats the portion of the outer surface of the heated roller facing the emission area of the infrared lamp. The hot air produced by the infrared lamp accumulates in the upper area inside the heated roller. The upper part of the heated roller is therefore subject to higher operating temperatures than the lower part. The consequence is that the areas of the fabric that, during operation, come into contact with the lower part of the heated roller are subjected to a thermosetting of the colors that can take place at a different temperature with respect to the areas of the fabric that come into contact with the upper part of the heated roller. This could produce different shades of color of the fabric, resulting in an undesired effect of color unevenness.

SUMMARY OF THE INVENTION

The present invention aims to provide a method and a unit for thermosetting of printed fabrics that overcome the problems of the prior art.

According to the present invention, this object is achieved by a method and by a thermosetting unit having the characteristics described herein.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
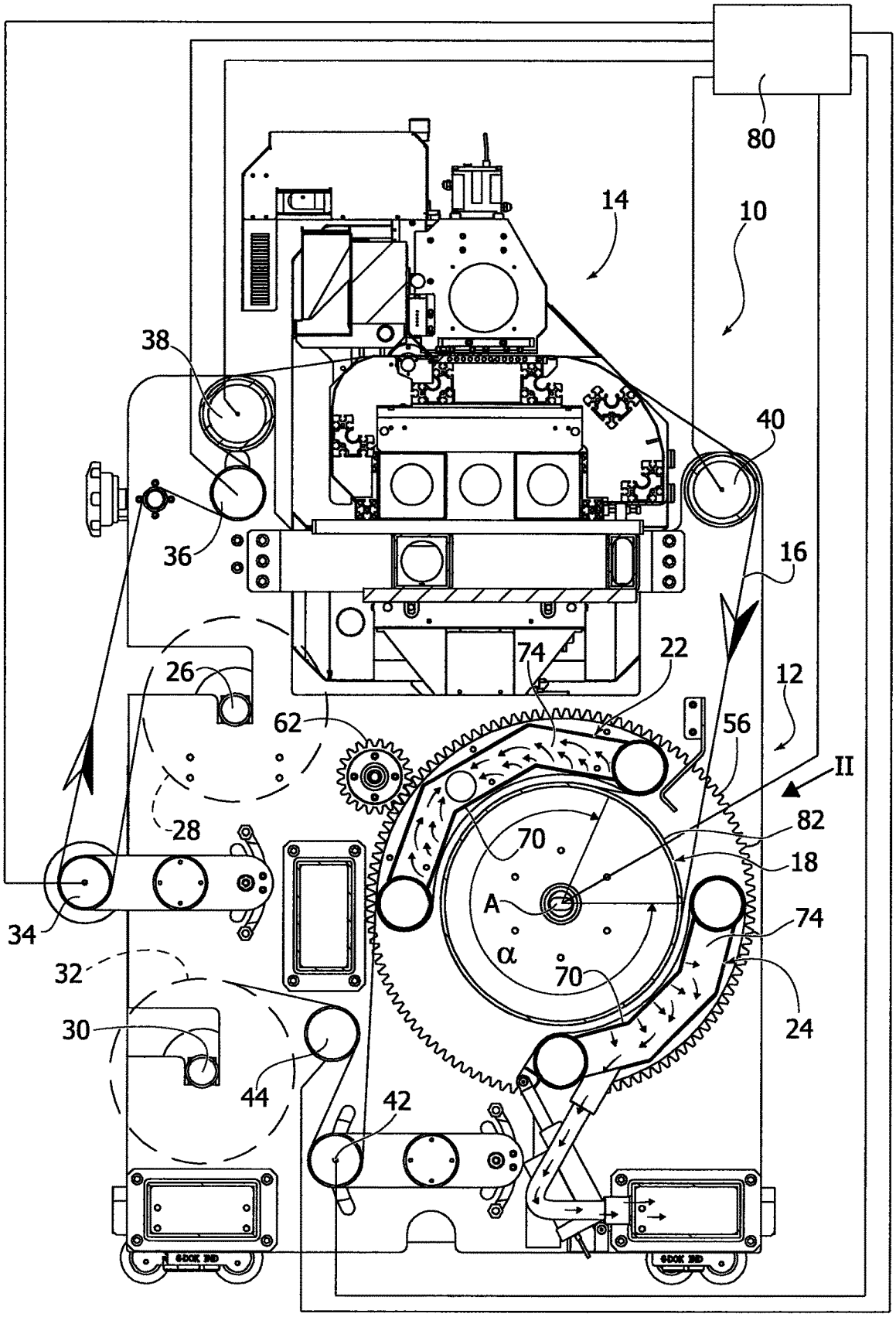
FIG. 1 is a schematic side view of a textile printer comprising a thermosetting unit for printed fabrics.

With reference to FIG. 1, numeral 10 indicates a textile printer comprising a printing unit 14 for digital printing on a moving fabric 16 and a thermosetting unit 12 for thermosetting of the printed fabric 16. The thermosetting unit 12 comprises a heated roller 18 rotatable about a horizontal rotation axis A. The moving fabric 16 wraps around the cylindrical outer surface of the heated roller 18, with a wrapping angle $\alpha$.

The thermosetting unit 12 comprises at least one fabric guiding element for guiding the fabric 16 in contact with the cylindrical outer surface of the heated roller 18. In the illustrated example, the thermosetting unit 12 comprises two fabric guiding elements 22, 24 facing respective portions of the cylindrical outer surface of the heated roller 18. The fabric guiding elements 22, 24 have respective concave inner surfaces 70 facing the heated roller 18, which define respective gaps with respect to the cylindrical outer surface of the heated roller 18 and through which the fabric 16 passes in contact with the heated outer surface of the heated roller 18.

The outer surface of the heated roller 18 is heated to a temperature that can reach up to 200° C. As the fabric 16 passes around the heated roller 18, thermosetting of the inks on the fabric is carried out due to the heat transferred to the fabric by the heated roller 18.

The textile printer 10 comprises a first reel 26 on which a bobbin 28 of fabric to be printed is rotatably mounted, and a second reel 30 on which the printed fabric wraps downstream of the thermosetting unit 12, forming a bobbin 32. The textile printer 10 comprises a plurality of rollers 34, 36, 38, 40, 42, 44 which feed and guide the fabric 16 during movement through the printing head 14 and through the thermosetting unit 12.

The first guiding element 22 can be carried by an adjusting device, rotatable about the rotation axis A independently of the heated roller 18, which allows adjustment of the angular position of the first guiding element 22 with respect to the heated roller 18. The adjusting device comprises a pair of gears 56 to which the first guiding element 22 is fixed.

The gears 56 are rotated about the axis A by respective pinions 62 driven by an electric motor. This adjusting device is described in detail in a contemporary patent application by the same Applicant. The adjusting device allows adjustment of the wrapping angle α of the fabric 16 on the cylindrical outer surface of the heated roller 18. In the case in which adjustment of the wrapping angle α between the fabric 16 and the heated roller 18 is not required, the first guiding element 22 can be in a fixed position.

The first and second guiding elements 22, 24 may have respective suction chambers 74 connected to a suction device, for extracting fumes that develop during the thermosetting process, through holes formed on the respective inner walls 70. The fume extraction system is described in detail in a contemporary patent application by the same Applicant.

The textile printer 10 comprises an electronic control unit 80 which controls the electric motor that rotates the heated roller 18 about the rotation axis A, and the electric motors that control the motorized rollers 38, 40, which feed the fabric 16 through the printing head 14 and through the thermosetting unit 12.

Figure 2:
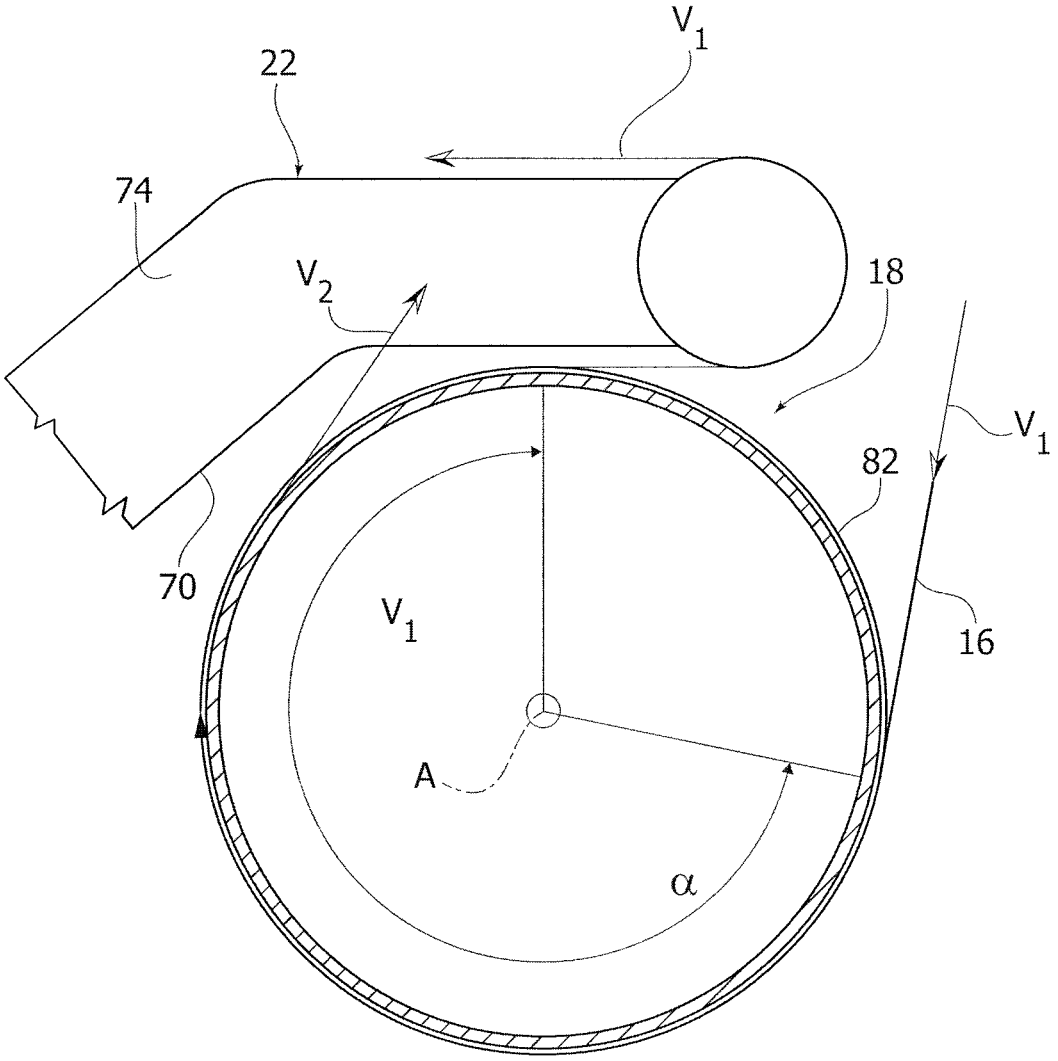
FIG. 2 is a schematic side view of the part indicated by the arrow II in FIG. 1 illustrating the speed of the fabric and the speed of the heated roller during the thermosetting process.

With reference to FIG. 2, the electronic control unit 80 is programmed to feed the fabric 16 onto the outer surface of the heated roller 18 with a speed V1, and to rotate the heated roller 18 with a peripheral speed V2, different from the speed V1 of the fabric 16. The peripheral speed V2 of the heated roller 18 can be higher than the speed V1 of the fabric 16. The ratio between the peripheral speed V2 of the heated roller 18 and the speed V1 of the fabric 16 can be comprises between 1.2 and 10.

To facilitate the sliding of the fabric 16 with respect to the cylindrical outer surface of the heated roller 18, the outer surface of the heated roller 18 may have a coating 82 of a low friction coefficient polymeric material, for example PTFE.

The fact that the heated roller 18 rotates with a greater peripheral speed V2 than the speed V1 of the fabric 16 prevents prolonged contact of the fabric 16 with areas at different temperatures of the outer surface of the heated roller 18. In fact, during operation, a relative movement is established between the outer surface of the heated roller 18 and the fabric 16. Consequently, the same area of the fabric 16 comes into contact with different portions of the outer surface of the heated roller 18. Thus, each portion of the fabric 16—during the passage on the outer surface of the heated roller 18—receives a quantity of heat that is a function of the average temperature of the outer surface of the heated roller 18. In this way, problems of dissimilarity of the thermosetting of the colors on the fabric due to the difference in temperature on the outer surface of the heated roller 18 are avoided. The non-stick coating 82 on the outer surface of the heated roller 18 allows the heated roller 18 to slide on the fabric 16 without friction problems.

Of course, without prejudice to the principle of the invention, the details of construction and the embodiments may be widely varied with respect to those described and illustrated, without thereby departing from the scope of the invention as defined by the claims that follow.

The invention claimed is:

1. A method for thermosetting printed fabrics, comprising:
providing a heated roller rotatable about a rotation axis and having a cylindrical outer surface;
advancing a printed fabric in contact with the cylindrical outer surface of the heated roller; and
wherein the heated roller is rotated with a peripheral speed different from the speed of the fabric.

2. A method according to claim 1, wherein the peripheral speed of the heated roller is greater than the speed of the fabric.

3. A method according to claim 1, wherein the ratio between the peripheral speed of the heated roller and the speed of the fabric is comprised between 1.2 and 10.

4. A method according to claim 1, wherein the cylindrical outer surface of the heated roller has a coating of polymeric material with a low coefficient friction.

5. A unit for thermosetting printed fabrics, comprising:
a heated roller rotatable about a rotation axis and having a cylindrical outer surface;
a plurality of motorized rollers arranged for advancing a printed fabric in contact with the cylindrical outer surface of the heated roller; and
an electronic control unit programmed to rotate said heated roller at a peripheral speed different from the speed of the fabric.

6. A thermosetting unit according to claim 5, wherein said electronic control unit is programmed to rotate said heated roller at a peripheral speed greater than the speed of the printed fabric.

7. A thermosetting unit according to claim 5, wherein said electronic control unit is programmed to set a ratio between the peripheral speed of the heated roller and the speed of the printed fabric in a range between 1.2 and 10.

8. A thermosetting unit according to claim 5, wherein said heated roller has a non-stick polymeric coating on its cylindrical outer surface.

* * * * *